US006158732A

United States Patent [19]

Tomiyama et al.

[11] Patent Number: 6,158,732

[45] Date of Patent: Dec. 12, 2000

[54] SHEET FEEDER FOR TRANSFERRING A RECTANGULAR SHEET

[75] Inventors: Katsuya Tomiyama, Tokyo; Hiroshi Yoshizaki, Kanagawa, both of Japan

[73] Assignee: NEC Corporation, Tokyo, Japan

[21] Appl. No.: 09/280,829

[22] Filed: Mar. 30, 1999

[30] Foreign Application Priority Data

Oct. 2, 1998 [JP] Japan ..... 10-281371

[51] Int. Cl.[7] ..... B65H 1/02

[52] U.S. Cl. ..... 271/31.1; 271/94; 271/150; 198/817; 198/456; 414/798.9

[58] Field of Search ..... 271/94, 31.1, 34, 271/903, 149, 150, 275, 197, 198, 177, 202; 198/817, 456; 414/798.9

[56] References Cited

U.S. PATENT DOCUMENTS 4,523,753 6/1985 Hiromori et al. ..... 271/31.1
4,595,188 6/1986 Wiley et al. ..... 271/31.1
4,789,148 12/1988 Noguchi et al. ..... 271/34
5,297,785 3/1994 Ricciardi ..... 271/150
5,785,488 7/1998 Raschke et al. ..... 271/31.1

FOREIGN PATENT DOCUMENTS 0150636 6/1989 Japan ..... 271/150

*Primary Examiner*—H. Grant Skaggs
*Attorney, Agent, or Firm*—Sughrue, Mion, Zinn, Macpeak & Seas, PLLC

[57] ABSTRACT

A sheet feeder for feeding mails includes a mounting table having a slanted top surface for mounting thereon a plurality of sheets in a substantially upright posture thereof, a transfer belt for transferring the sheets in the slanted posture in the direction perpendicular to the surfaces of the sheets, and a take-out section for taking out the sheets in the horizontal direction parallel to the surfaces of the sheets. A mail having an envelope and a belt wrapper covering the envelope can be taken out as it is, without pulling-off of the belt wrapper from the envelope.

14 Claims, 8 Drawing Sheets

SHEET FEEDER FOR TRANSFERRING A RECTANGULAR SHEET

BACKGROUND OF THE INVENTION (a) Field of the Invention

The present invention relates to sheet feeder for transferring a rectangular sheet and, more particularly, to a sheet feeder for feeding a plurality of sheets, such as mail cards and envelopes, having different sizes, weights and shapes. The present invention also relates to a method for feeding a plurality of sheets one by one.

(b) Description of the Related Art

A sheet feeder for feeding a plurality of sheets thereof separately one by one in an upright posture thereof is generally used in a mail office for handling a large number of mail cards and mail envelopes.

FIG. 1 is a top plan view of a conventional sheet feeder. The sheet feeder includes a mounting table 41 for mounting thereon a plurality of sheets in an upright posture thereof, a transfer section 42 for transferring the sheets on top of the mounting table 41, and a take-out section 46 for taking out the sheets, transferred by the transfer section 42, one by one separately. The transfer section 42 includes a guide plate 43 for aligning and guiding the one of the side edges of the sheets, a bottom belt 44 for transferring the sheets in the direction perpendicular to the surfaces of the sheets while supporting the bottom edges of the sheets, and a plurality of compartments 45 for separating the sheets from one another. The take-out section 46 includes a vacuum chamber 47 maintained at a vacuum, and a suction belt 48 having a plurality of openings 50 communicated with the vacuum chamber 47 for suction of the sheet one by one. The suction belts 48 transfers the sheets around the vacuum chamber 47 while attaching the sheet to the suction belt 48 by the openings 50. A take-out belt 49 is disposed below the take-out section 46 for further transferring the sheets taken out by the suction belt 48. The mounting table 41, the transfer section 42 and the take-out section 46 are arranged substantially in a horizontal plane.

The sheet feeder of FIG. 1 operates as follows. First, the sheets mounted on the mounting table 41 at an upright posture thereof are separated from one another and applied with a thrust force at the entire rectangular surfaces thereof by the compartments 45. The sheets are transferred toward the take-out section 46 by the bottom belt 44 and the compartments 45 along the guide plate 43 in the direction of arrow A. The sheets transferred to the take-out section 46 is then subjected to suction by the suction belt 48 one by one, transferred by the revolution of the suction belt 48 around the vacuum chamber 47, and finally taken out by the take-out belt 49 in the direction of arrow B.

In the sheet feeder of FIG. 1, suppose that, as shown in FIG. 2 which is a side view taken in the direction of arrow A in FIG. 1, a mail 30 is supplied thereto having an envelope 31 with a belt wrapper 32 covering thereon for indicating the destination address of the envelope 32. In this case, there is a possibility that only the belt wrapper 32 is transferred by the suction belt 48 while leaving the envelope 31 separated from the belt wrapper 32, as shown in FIG. 3. The separation of the belt wrapper causes a problem that the mail envelope loses its destination address.

SUMMARY OF THE INVENTION

In view of the above, it is an object of the present invention to provide a sheet feeder capable of accurately transferring a mail, especially, such as a mail having an envelope and a belt wrapper covering thereon.

The present invention provides a sheet feeder comprising a mounting table for mounting thereon a sheet having a substantially rectangular surface in a substantially upright posture thereof, a transfer section for transferring the sheet in a direction perpendicular to the substantially rectangular surface, and a take-out section for taking out the sheet, transferred by the transfer section, in a direction parallel to the substantially rectangular surface and slanted with respect to an edge of the substantially rectangular surface.

In accordance with the sheet feeder of the present invention, the slanted direction of the take-out by the take-out section provides a frictional force between the belt wrapper and the envelope, resulting in the advantage in which it is assured that the envelope is transferred together with the belt wrapper by the take-out section without losing the destination address of the envelope.

The above and other objects, features and advantages of the present invention will be more apparent from the following description, referring to the accompanying drawings.

PREFERRED EMBODIMENT OF THE INVENTION

Figure 1:
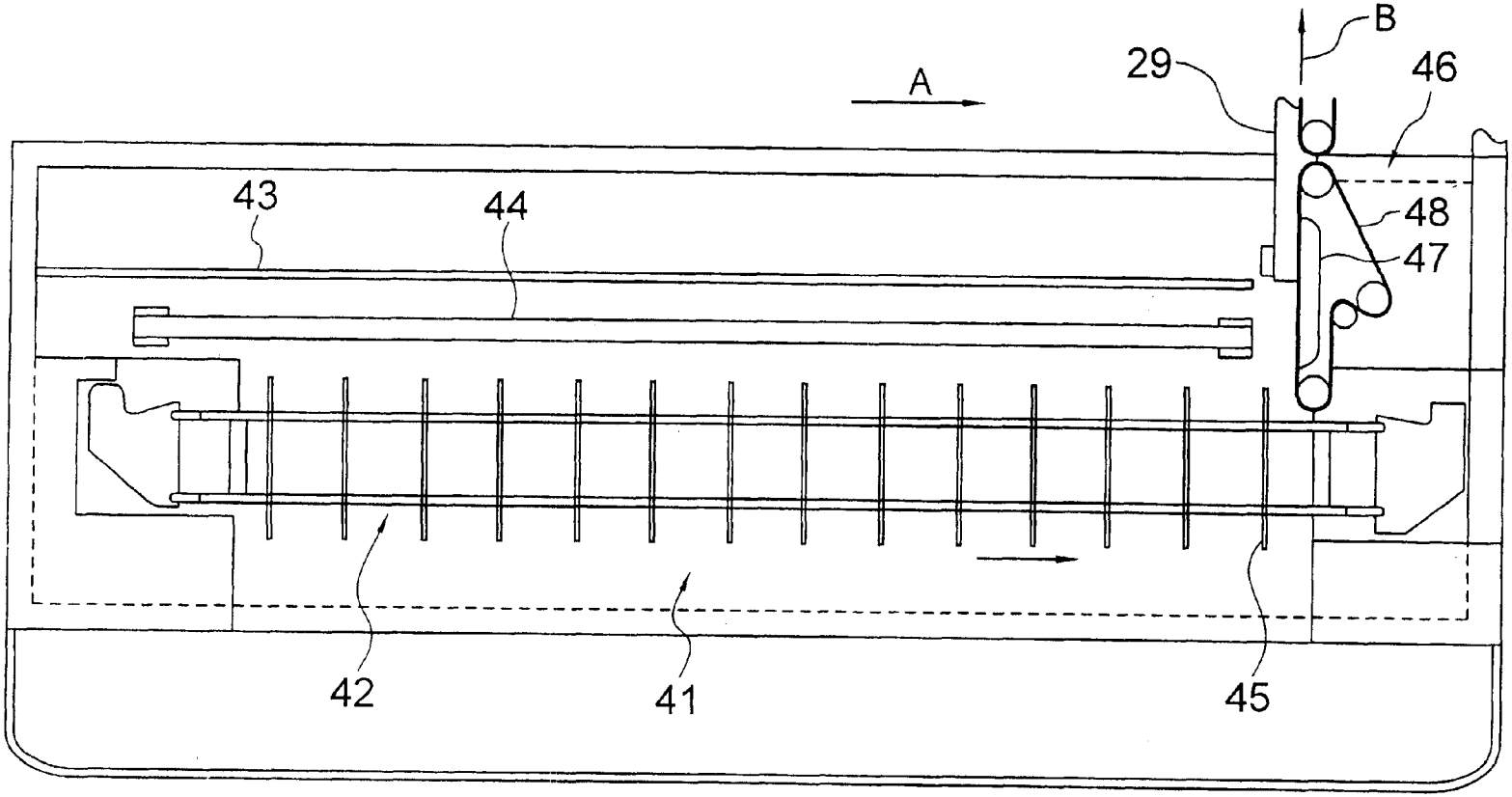
FIG. 1 PRIOR ART
FIG. 1 is a top plan view of a conventional sheet feeder.
Figure 2:
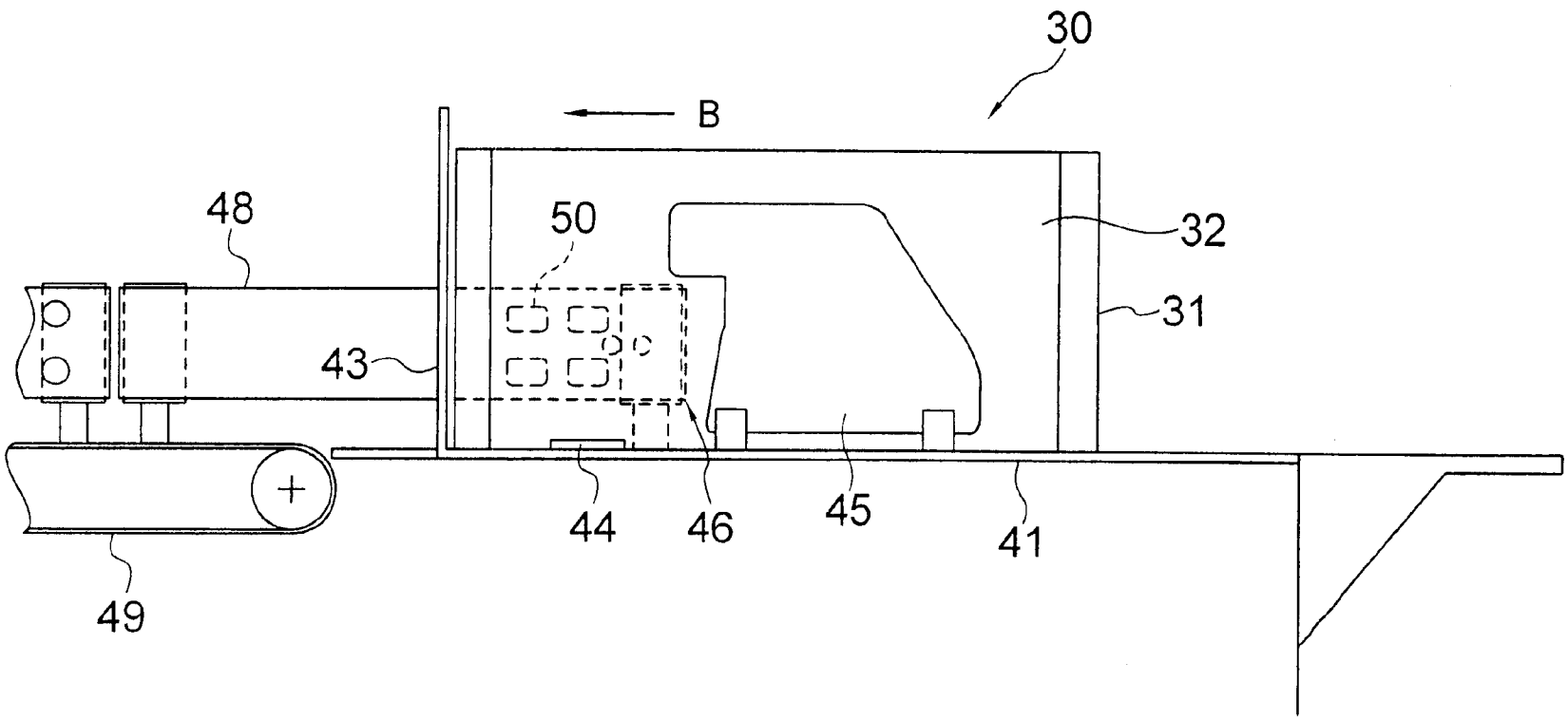
FIG. 2 PRIOR ART
FIG. 2 is a side view of the sheet feeder of FIG. 1 taken in the direction of arrow A in FIG. 1.
Figure 3:
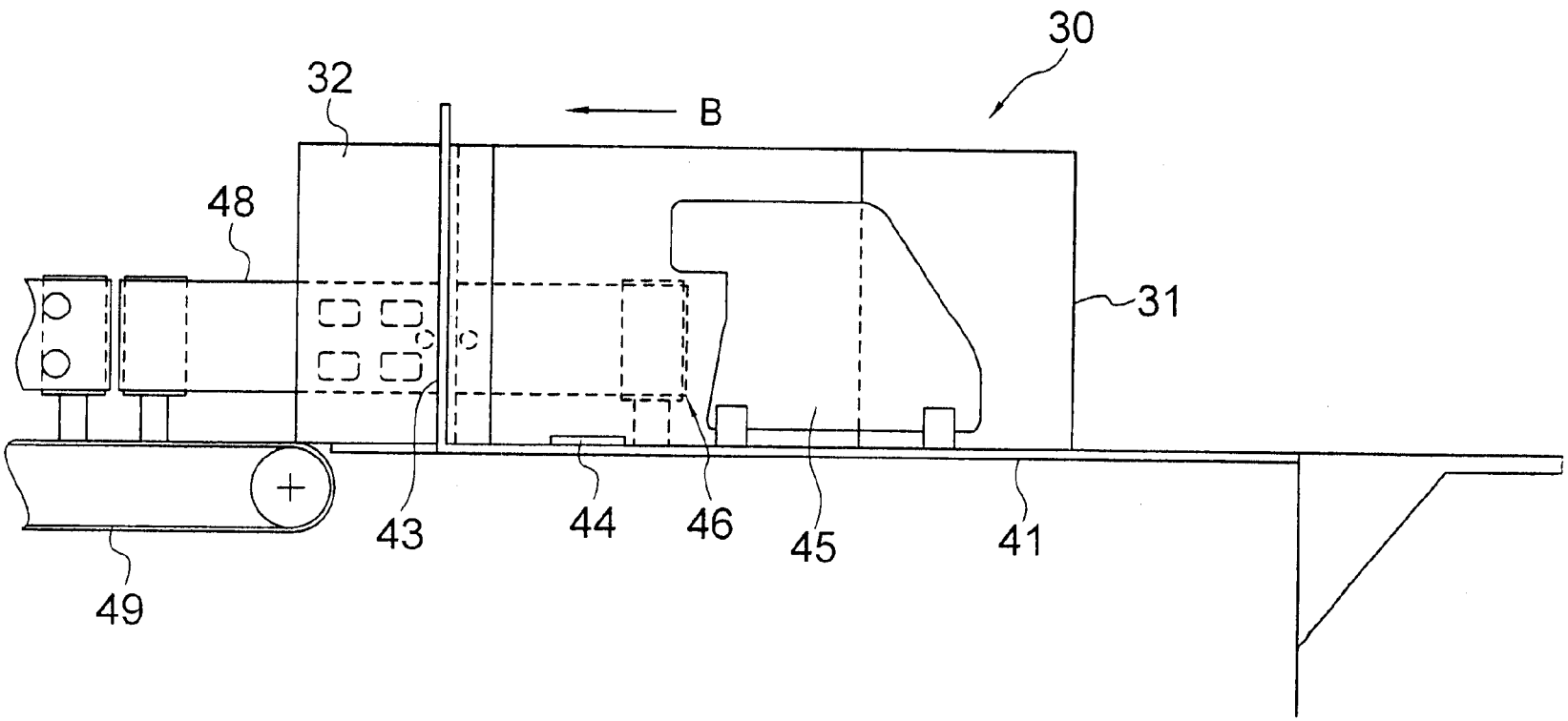
FIG. 3 PRIOR ART
FIG. 3 is another side view of the sheet feeder of FIG. 1 taken in the direction of arrow A in FIG. 1.
Figure 4:
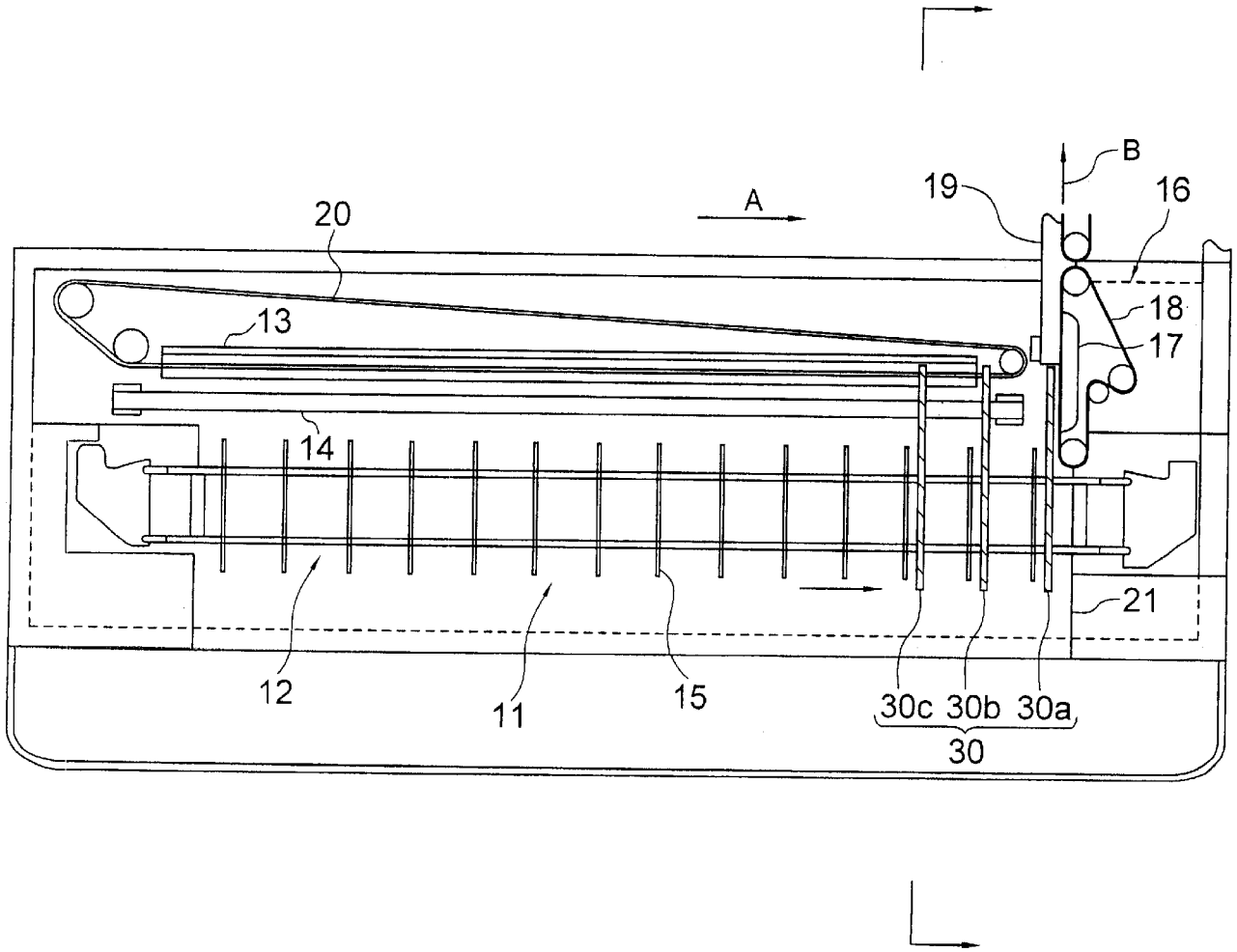
FIG. 4 is a top plan view of a sheet feeder according to an embodiment of the present invention.

Referring to FIG. 4, a sheet feeder according to an embodiment of the present invention includes a mounting table 11 for mounting thereon a plurality of sheets 30 each in an up-right posture thereof, a transfer section 12 for transferring the sheets 30 mounted on the mounting table 11 in the direction of arrow A perpendicular to the surfaces of the sheets 30, and a take-out section 16 for taking out the sheets 30, transferred by the transfer section 12, one by one in the direction of arrow B parallel to the surfaces of the sheets 30.

The transfer section 12 includes a guide plate 23, extending along the transfer direction of the sheets 30 on the top surface of the mounting table 11, for guiding front edges of the sheets 30. The transfer section 12 further includes a bottom belt 14 for transferring the sheets 30 while supporting the bottom edges of the sheets 30, a side belt 20 for transferring the sheets 30 while supporting the front edges of the sheets, and a plurality of compartments 15 for transferring the sheets 30 together with the bottom belt 14 and the side belt 20 while moving along the direction of arrow A at a speed equal to the speed of both the belts 14 and 20.

Figure 5:
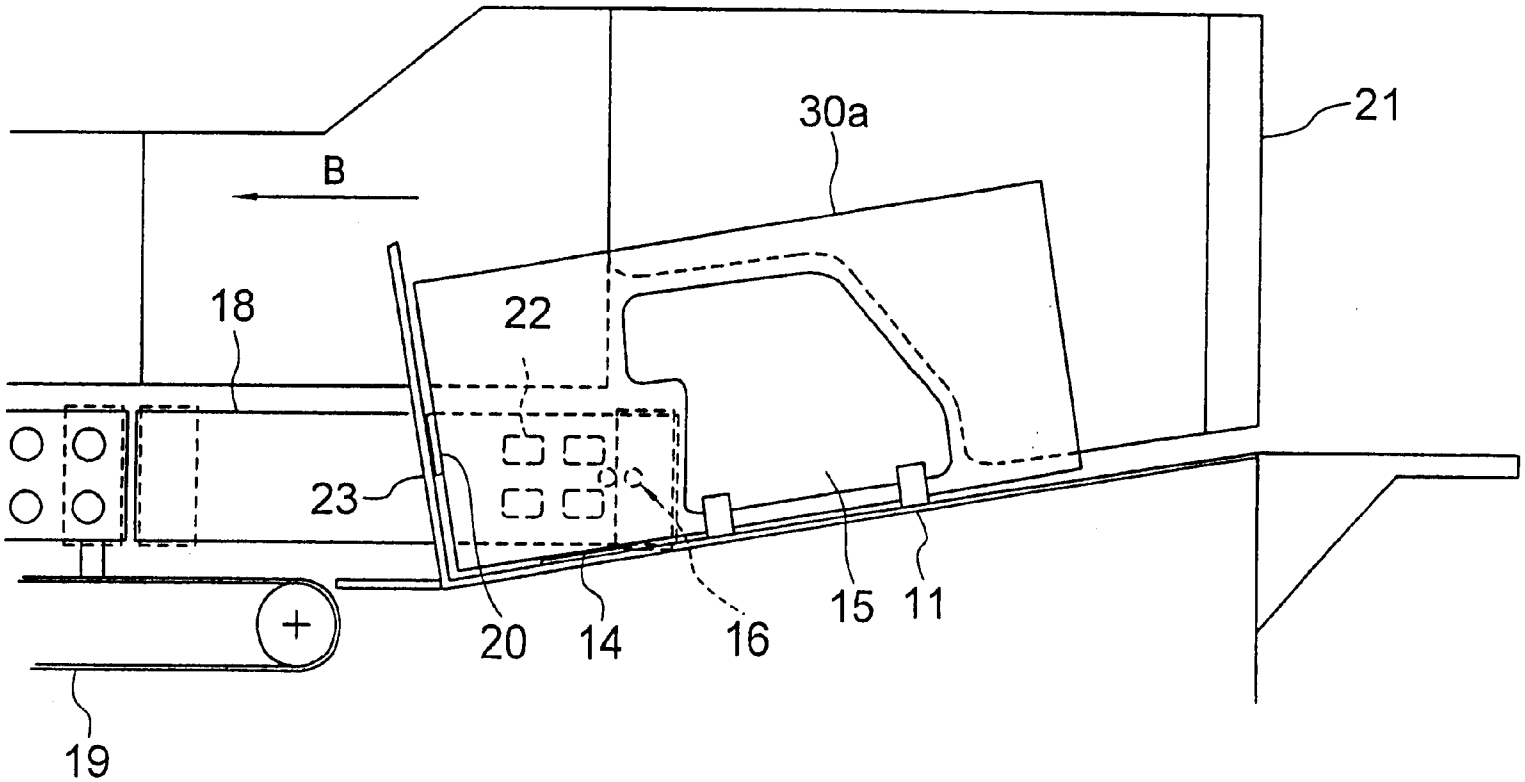
FIG. 5 is a side view of the sheet feeder of FIG. 4 taken in the direction of arrow A in FIG. 4.

Referring to FIG. 5, the mounting table 11 has a slope on the top surface thereof, and the slope is such that the top surface of the mounting table 11 falls in the direction of arrow B, i.e., the direction of take-out of the sheet 30*a* by the take-out section 16. The sheet 30*a* mounted on the mounting table 11 at the end of the transfer section 12 has a substantially rectangular surface.

The take-out section 16 includes a vacuum chamber 17 maintained at a vacuum, a suction belt 18 having a plurality of openings 22, communicated with the vacuum chamber 17, for attaching the sheets by suction to the suction belt 18 one by one. A take-out belt 19 is provided below the take-out section 16 for take-out of the sheets supplied from the suction belt 18. At the end of the transfer section 12, an end plate 21 is disposed for stopping the sheets transferred by the transfer section 12.

Figure 6:
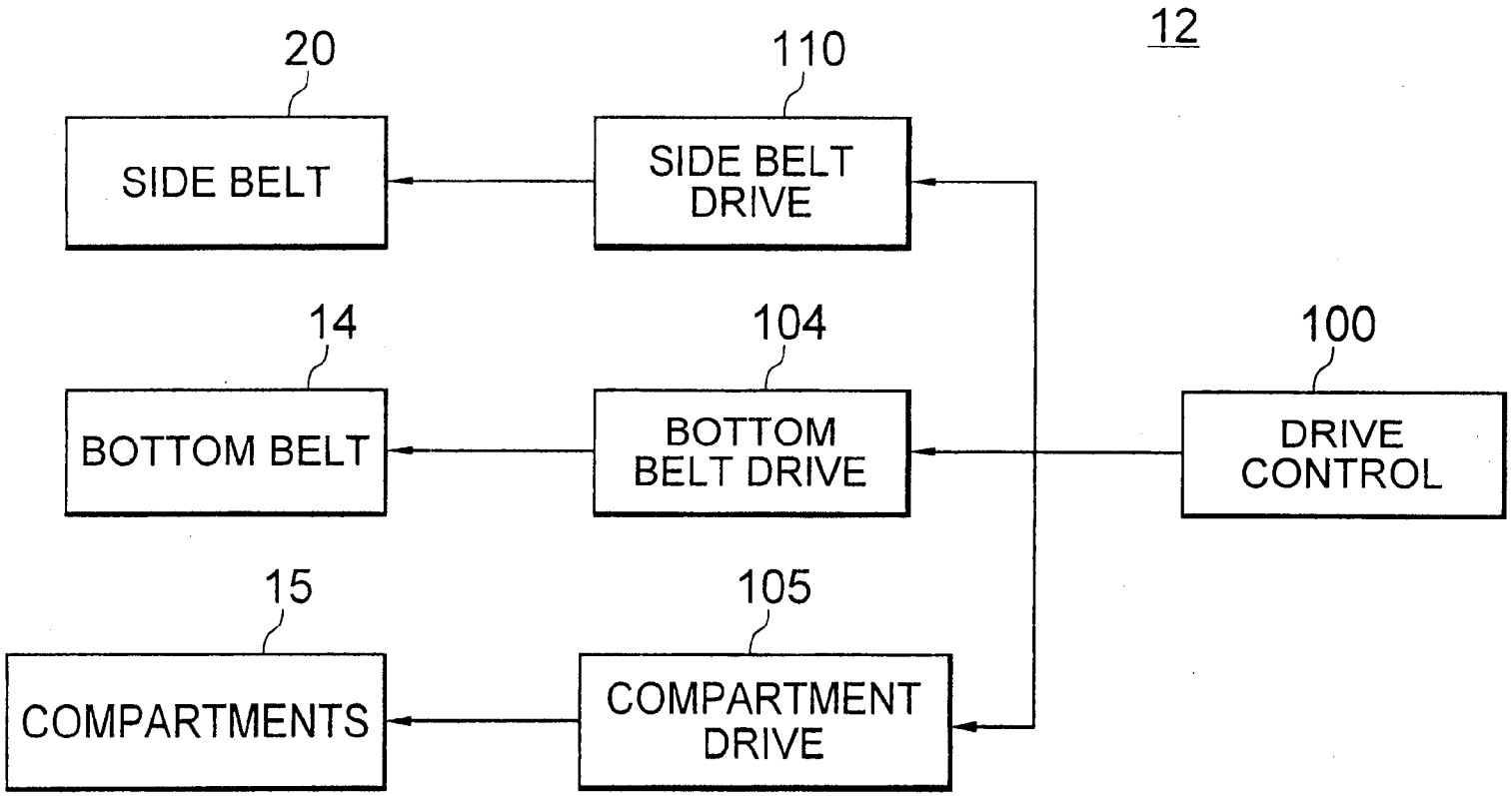
FIG. 6 is a block diagram of the transfer section in the sheet feeder of FIG. 4.

Referring to FIG. 6, in the transfer section 12, a drive control section 100 controls a side belt drive 110, a bottom belt drive 104 and a compartment drive 105 to drive the side belt 20, the bottom belt 14 and the compartment 15, respectively, at an equal speed in the same direction. The drive control is implemented by a central processor for controlling the overall operation of the sheet feeder.

In operation of the sheet feeder of the present embodiment, rectangular sheets 30 are mounted on the mounting table 11 in a slightly inclined posture thereof, as viewed in the direction perpendicular to the transfer direction of the sheet, in conformity with the inclined top surface of the mounting table 11. The sheets 30 are transferred by the bottom belt 14, the side belt 20 and the compartments 15 while being supported thereby toward the take-out section 16. The sheets are stopped by the end plate 21, then attached to the suction belt 18 one by one in the order of 30*a*, 30*b*, 30*c*, . . . to be taken out in the direction of arrow B by the take-out section 16.

Figure 7:
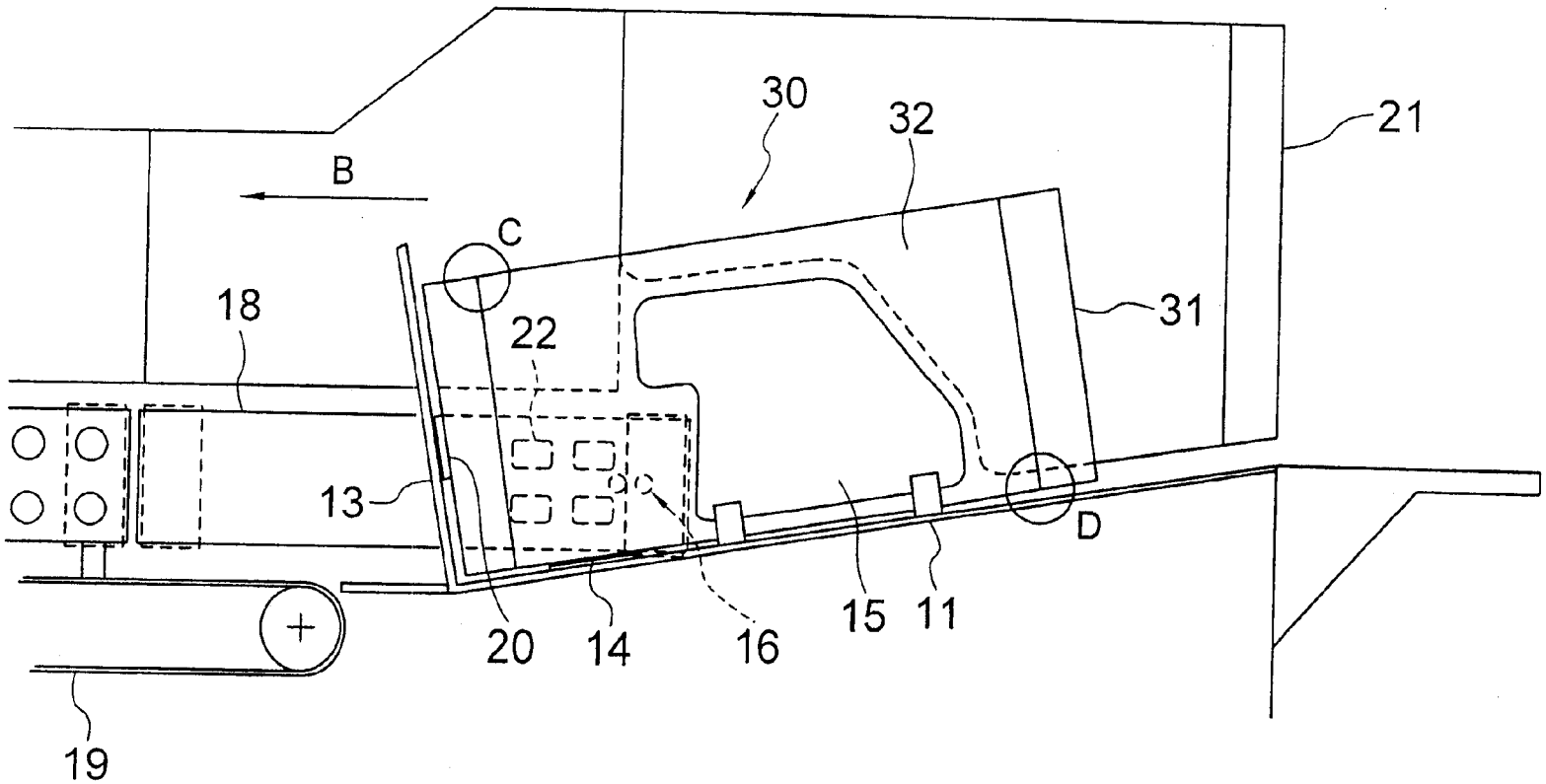
FIG. 7 is another side view of the sheet feeder of FIG. 4 taken in the direction of arrow A in FIG. 4.
Figure 8:
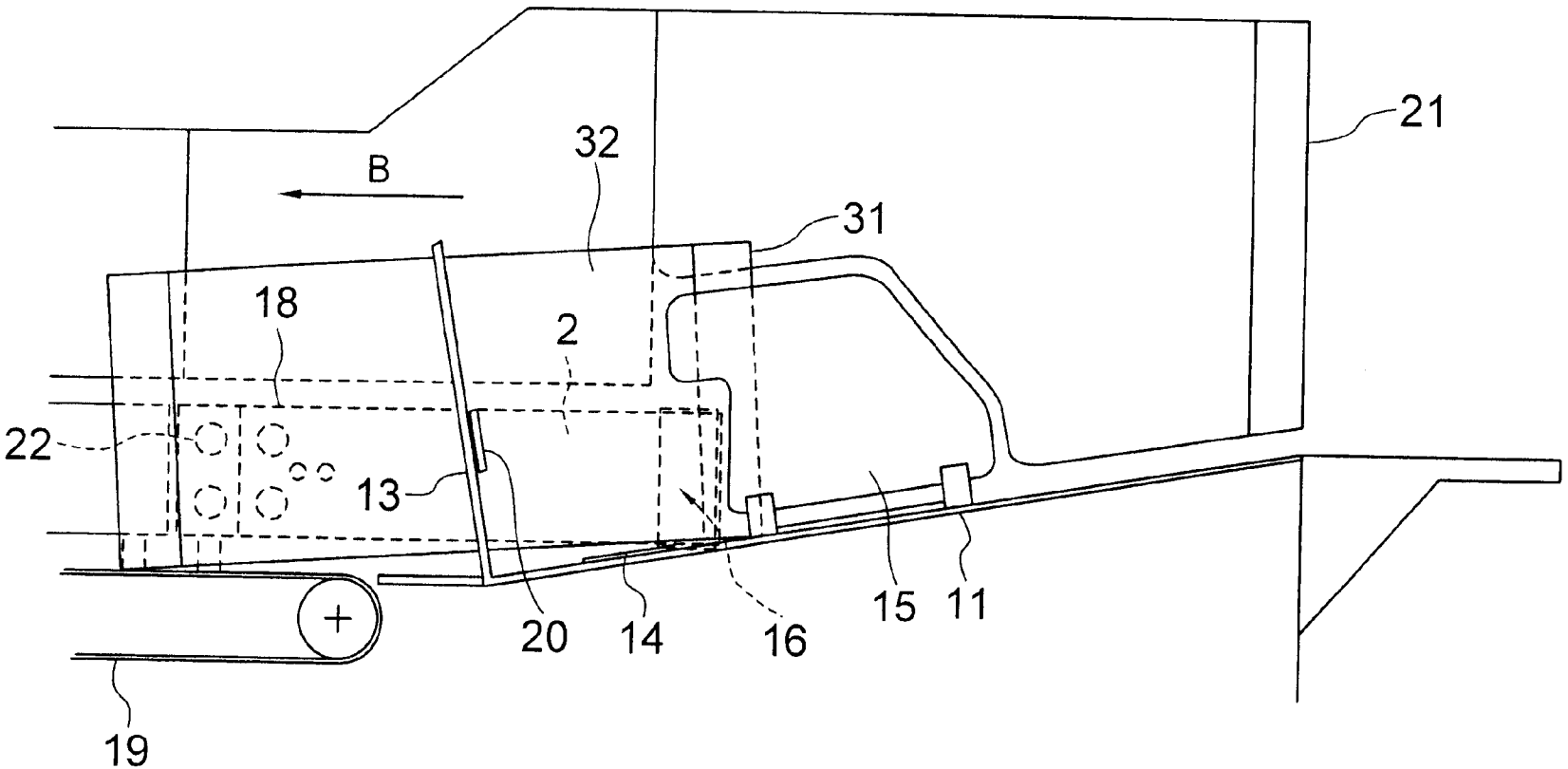
FIG. 8 is another side view of the sheet feeder of FIG. 4 taken in the direction of arrow A in FIG. 4.

If a mail having an envelope with a belt wrapper covering the envelope for indicating the destination address of the envelope, the mail is transferred as shown in FIGS. 7 and 8. In FIG. 7, the belt wrapper 32 of the mail 30 disposed at the end of the transfer section is attached to the suction belt 18 by the function of the openings 22 to be transferred in the horizontal direction of arrow B. The mail 30 is supported by the bottom belt 14 parallel to the top surface of the mounting table 11, which is inclined with respect to the horizontal plane, whereas the take-out of the belt wrapper 32 by the take-out section 16 is effected in the horizontal direction. Thus, there occurs a frictional force between the belt wrapper 32 and the envelope 31 at each of the points C and D shown in FIG. 7, or the top-front corner and the bottom-rear corner of the belt wrapper 32, the frictional force urging the envelope 31 to advance in the direction of arrow B together with the belt wrapper 32, as shown in FIG. 8. The sheet feeder of the present embodiment can effectively transfer and feed a mail to the take-out belt 19, even in the case that the mail 30 has an envelope 31 with a belt wrapper 32 covering the envelope 31 in a loose state, which may cause pulling-off of the belt wrapper 32 from the envelope 31 in the conventional sheet feeder.

In the above embodiment, the description is directed to a sheet feeder for feeding sheets including a mail having a rectangular envelope and a belt wrapper covering thereon. However, the sheet feeder of the present invention can be applied to any of such sheets including a mail card with or without a belt wrapper as well as a case having a belt wrapper thereon, for example, a cigarette case. Thus, a feeder for transferring such goods or articles is also referred to as a sheet feeder in this text. The sheet feeder of the present embodiment is especially adapted for use in transferring a mixture of mails including mail cards and mail envelopes each with or without a belt wrapper.

Since the above embodiments are described only for examples, the present invention is not limited to the above embodiments and various modifications or alterations can be easily made therefrom by those skilled in the art without departing from the scope of the present invention.

What is claimed is:

1. A sheet feeder comprising a mounting table for mounting thereon a sheet having a substantially rectangular surface in a substantially upright posture thereof, a transfer section for transferring the sheet in a direction perpendicular to the substantially rectangular surface, and a take-out section for taking out the sheet, transferred by said transfer section, in a direction parallel to the substantially rectangular surface and slanted with respect to an edge of the substantially rectangular surface.

2. The sheet feeder as defined in claim 1, wherein said mounting table mounts thereon the sheet in a posture at which a bottom edge of the substantially rectangular surface is slanted with respect to a horizontal plane.

3. The sheet feeder as defined in claim 2, the bottom edge is slanted such that the bottom edge falls in the direction of take-out by the take-out section.

4. The sheet feeder as defined in claim 1, wherein said mounting table comprises a sheet guide for guiding a side edge of the substantially rectangular surface in a direction of transferring by said transfer section.

5. The sheet feeder as defined in claim 1, wherein said transfer section comprises a bottom belt for moving the sheet while supporting a bottom edge of said substantially rectangular surface, a side belt for moving the sheet while supporting a side edge of said substantially rectangular surface, a compartment for moving the sheet separately from another sheet, and a control section for driving said bottom belt, said side belt and said compartment at an equal speed.

6. The sheet feeder as defined in claim 1, wherein said take-out section comprises a vacuum chamber maintained at a vacuum, and a suction belt having an opening, communicated with said vacuum chamber, for attaching the sheet to the suction belt.

7. The sheet feeder as defined in claim 1, wherein said sheet feeder is adapted to processing a mail card with or without a wrapper, a mail envelope with or without a wrapper, or a mixture thereof.

8. A method for transferring a sheet having a substantially rectangular surface, comprising the steps of mounting the sheet in a substantially upright posture of the substantially rectangular surface, transferring the sheet in a direction perpendicular to the substantially rectangular surface, taking out the sheet in a direction parallel to the substantially rectangular surface and slanted with respect to an edge of the substantially rectangular surface.

9. The method as defined in claim 8, wherein said method handles a mail card with or without a wrapper, a mail envelope with or without a wrapper, or a mixture thereof.

10. A package feeder, comprising:

a mounting table adapted to receive thereon a package having a substantially rectangular surface in a substantially upright posture thereof;

a transfer section which transfers the package in a direction perpendicular to the substantially rectangular surface; and a take-out section having a suction device which takes out the package transferred by said transfer section;

wherein said transfer section is adapted to transfer the package to said take-out section so that said suction device receives the package in an inclined orientation and so that said suction device takes out the package in a direction slanted with respect to an edge of the substantially rectangular surface of the package.

11. The package feeder according to claim 10, wherein the package is one of a card, envelope, and box.

12. A method of transferring a package having a substantially rectangular surface, comprising the steps of:

mounting the package in a substantially upright posture on a table adapted to receive thereon the package having a substantially rectangular surface;

transferring the package in a transfer section in a direction perpendicular to the substantially rectangular surface; and taking out the package from the transfer section using a suction device;

wherein said step of transferring the package includes transferring the package to said take-out section so that said suction device receives the package in an inclined orientation; and wherein said step of taking out the package includes using the suction device to take out the package in a direction slanted with respect to an edge of the substantially rectangular surface of the package.

13. The method according to claim 12, wherein the package is one of a card, envelope, and box.

14. The method according to claim 12, wherein the package has a wrapper wrapped around only two opposing edges of the package, and wherein the step of taking out the package from the transfer section includes using the suction device to grab the package by the wrapper.

* * * * *